US009610673B2

(12) United States Patent
Torikoshi

(10) Patent No.: US 9,610,673 B2
(45) Date of Patent: Apr. 4, 2017

(54) POLISHING METHOD AND APPARATUS

(71) Applicant: EBARA CORPORATION, Tokyo (JP)

(72) Inventor: Tsuneo Torikoshi, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/160,928

(22) Filed: Jan. 22, 2014

(65) Prior Publication Data

US 2014/0213157 A1 Jul. 31, 2014

(30) Foreign Application Priority Data

Jan. 25, 2013 (JP) ..... 2013-011917

(51) Int. Cl.

| | |
|---|---|
| ***B24B 49/18*** | (2006.01) |
| ***B24B 53/017*** | (2012.01) |
| ***B24B 53/007*** | (2006.01) |
| ***B24B 37/005*** | (2012.01) |
| ***B24B 37/013*** | (2012.01) |
| ***B24B 37/04*** | (2012.01) |
| ***B24B 37/34*** | (2012.01) |
| ***B24B 27/00*** | (2006.01) |

(52) U.S. Cl.

CPC ..... *B24B 53/017* (2013.01); *B24B 27/0023* (2013.01); *B24B 37/005* (2013.01); *B24B 37/013* (2013.01); *B24B 37/042* (2013.01); *B24B 37/345* (2013.01); *B24B 49/18* (2013.01); *B24B 53/007* (2013.01)

(58) Field of Classification Search

CPC ..... B24B 49/18; B24B 37/005; B24B 37/042; B24B 37/013; B24B 37/10; B24B 37/345; B24B 53/007; B24B 53/017

USPC ..... 451/9, 10, 11, 41, 54, 56, 285, 287

See application file for complete search history.

(56) References Cited

U.S. PATENT DOCUMENTS

| | | | | | |
|---|---|---|---|---|---|
| 4,680,893 | A | * | 7/1987 | Cronkhite et al. | 451/57 |
| 5,578,529 | A | * | 11/1996 | Mullins | 438/692 |
| 5,738,574 | A | * | 4/1998 | Tolles et al. | 451/288 |
| 5,934,980 | A | * | 8/1999 | Koos et al. | 451/41 |
| 6,132,294 | A | * | 10/2000 | Lin | 451/41 |

(Continued)

FOREIGN PATENT DOCUMENTS

| | | |
|---|---|---|
| JP | 2007-075973 | 3/2007 |
| JP | 2010-258228 | 11/2010 |
| JP | 2012-094582 | 5/2012 |

*Primary Examiner* — Eileen Morgan

(74) *Attorney, Agent, or Firm* — Leydig, Voit & Mayer, Ltd.

(57) ABSTRACT

A polishing method is used for polishing a surface of a substrate such as a semiconductor wafer. The polishing method includes a polishing process for polishing a surface of the substrate in accordance with a preset polishing recipe, a pad cleaning process for removing foreign matters on the polishing pad by ejecting a cleaning fluid onto the polishing pad, and a substrate transferring process in which the polished substrate is removed from the top ring at a substrate transferring position, a subsequent substrate to be polished is loaded onto the top ring, and then the top ring holding the subsequent substrate to be polished is returned to the polishing table. The pad cleaning process is started after the completion of the polishing recipe is detected, and the pad cleaning process is terminated by detecting a position of the subsequent substrate to be polished which is undergoing the substrate transferring process.

10 Claims, 6 Drawing Sheets

(56) References Cited

U.S. PATENT DOCUMENTS

| | | | | |
|---|---|---|---|---|
| 6,183,345 | B1 * | 2/2001 | Kamono et al. | 451/8 |
| 6,220,941 | B1 * | 4/2001 | Fishkin et al. | 451/63 |
| 2005/0186891 | A1 * | 8/2005 | Benner | 451/56 |
| 2006/0035563 | A1 * | 2/2006 | Kalenian et al. | 451/5 |
| 2007/0060024 | A1 * | 3/2007 | Shirasu et al. | 451/41 |
| 2009/0305612 | A1 | 12/2009 | Miyazaki et al. | |

* cited by examiner

POLISHING METHOD AND APPARATUS

CROSS REFERENCE TO RELATED APPLICATION

This document claims priority to Japanese Application Number 2013-011917 filed Jan. 25, 2013, the entire contents of which are hereby incorporated by reference.

BACKGROUND OF THE INVENTION

Field of the Invention

The present invention relates to a polishing method and apparatus for polishing a surface of a substrate such as a semiconductor wafer by relative movement between the surface of the substrate and a polishing pad on a polishing table while the substrate is pressed against the polishing pad.

Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, while a polishing liquid (slurry) containing abrasive particles, such as silica ($SiO_2$), ceria ($CeO_2$) or the like, therein is supplied onto a polishing pad, a substrate such as a semiconductor wafer is brought into sliding contact with the polishing pad and polished by using a polishing apparatus.

The polishing apparatus which performs the above-mentioned CMP process includes a polishing table having a polishing pad, and a substrate holding apparatus, which is referred to as a top ring or a polishing head, for holding a semiconductor wafer (substrate). When the semiconductor wafer (substrate) is polished with such a polishing apparatus, the semiconductor wafer is held and pressed against a surface (polishing surface) of the polishing pad under a predetermined pressure by the substrate holding apparatus while a polishing liquid (slurry) is supplied from a polishing liquid supply nozzle onto the polishing pad. At this time, the polishing table and the substrate holding apparatus are respectively rotated to bring the semiconductor wafer into sliding contact with the polishing surface, so that the surface of the semiconductor wafer is polished to a flat mirror finish, as disclosed in Japanese laid-open patent publication No. 2007-75973.

As described above, the polishing apparatus polishes the substrate by rotating the polishing table while the polishing liquid (slurry) is supplied from the polishing liquid supply nozzle onto the polishing pad. Therefore, there is a problem that mist of slurry supplied onto the polishing pad is scattered around. Further, after polishing of the substrate, water polishing of the substrate or cleaning of the substrate is performed by rotating the polishing table while pure water (deionized water) is supplied from the polishing liquid supply nozzle onto the polishing pad. Therefore, there is a problem that mist of pure water or the like supplied onto the polishing pad is scattered around. In this manner, the interior of the polishing apparatus is such an environment as to cause mist of slurry, pure water or the like, or water droplets to be scattered, and thus the scattered mist of slurry or the like is attached onto various portions in the polishing apparatus. If the attached mist is dried, the abrasive particles are agglomerated and fall onto the surface of the polishing pad during polishing, causing scratches on the surface of the substrate.

Accordingly, in the CMP process, there is a risk that the scratches due to agglomerate of the particles such as slurry are increased, thus causing a lowering of the yield. The scratches are mainly caused by falling of the agglomerated abrasive particles onto the polishing pad. As a method for preventing the fallen abrasive particles from entering between the polishing pad and the substrate, it is common practice to take measures at the time of dressing of the polishing pad. For example, a dressing speed is lowered, or cleaning for washing the abrasive particles away with a mixed fluid of a liquid and a gas, or the like by an atomizer is performed after dressing.

In order to remove the above-described agglomerated abrasive particles, existing on the polishing pad, as much as possible, the longer cleaning time of the polishing pad by the atomizer is more preferable. However, in the conventional polishing apparatus, the dressing step of the polishing pad or the cleaning step of the polishing pad by the atomizer has been set in a polishing recipe. Therefore, it is necessary to prolong the cleaning time by altering the polishing recipe so as to lengthen the cleaning time of the polishing pad by the atomizer, and thus there is a problem to lower a throughput extremely.

The inventors of the present invention have reviewed various steps which have been conducted based on the polishing recipe in the polishing apparatus for the purpose of lengthening the cleaning time of the polishing pad (polishing surface) without lowering the throughput, and obtained the following knowledge. Specifically, after one substrate such as a semiconductor wafer is polished, there is a substrate transferring process for removing the polished substrate from the top ring and loading a new substrate on the top ring.

The inventors of the present invention have focused on the fact that there is a so-called idle time, at the time of the substrate transferring process, during which no process is performed on the polishing table, and have considered the possibility to prolong the cleaning time by cleaning the polishing pad during the idle time. In this case, it is considered to add a recipe of "execute cleaning of the polishing pad during the time until the polishing recipe is re-executed". However, when an executive instruction of the polishing recipe is made from a controller, the polishing recipe becomes in execution, and thus the completion of the polishing recipe cannot be detected by the polishing recipe itself, resulting in continuing the check whether the polishing recipe has been completed or not while the polishing recipe itself is being executed. In other words, if it is set as "during the time until the polishing recipe is re-executed", because neither the completion of the previous polishing recipe nor the start of a subsequent polishing recipe can be detected, the state where there is no other way than continuing the cleaning of the polishing pad, is continued. Accordingly, when "cleaning of the polishing pad" is added to the polishing recipe, the cleaning time is forced to be set, thus lowering the throughput.

Further, separately from the polishing recipe, it can be considered to have such a setting as "after completion of the polishing recipe, execute cleaning of the polishing pad for a predetermined time" in advance. However, the time between the polishing recipes is not constant because various substrates are supplied into the polishing apparatus, i.e. a variety of polishing recipes are executed. Accordingly, setting the cleaning time of the polishing pad each time for each substrate is troublesome and time-consuming. Further, if the cleaning time is not set each time, the cleaning time has to be set to the minimum time between respective polishing recipes, and therefore the idle time between the polishing recipes cannot be utilized to the utmost limit.

SUMMARY OF THE INVENTION

Based on the above knowledge obtained from various experiments, the present invention has been made. It is therefore an object of the present invention to provide a polishing method and apparatus which can perform cleaning of a polishing pad on a polishing table, by using an idle time in a substrate transferring process which is performed between polishing processes, to the utmost limit.

In order to achieve the above object, according to an aspect of the present invention, there is provided a polishing method for polishing a substrate, comprising: a polishing process for polishing a surface of the substrate by pressing the substrate against a polishing pad on a polishing table by a top ring, the polishing process being executed in accordance with a preset polishing recipe; a pad cleaning process for removing foreign matters on the polishing pad by ejecting a cleaning fluid onto the polishing pad; and a substrate transferring process in which the polished substrate is removed from the top ring at a substrate transferring position, a subsequent substrate to be polished is loaded onto the top ring, and then the top ring holding the subsequent substrate to be polished is returned to the polishing table; wherein the pad cleaning process is started after the completion of the polishing recipe is detected, and the pad cleaning process is terminated by detecting a position of the subsequent substrate to be polished which is undergoing the substrate transferring process.

According to the present invention, the polishing process in which the substrate is polished by pressing the substrate against the polishing pad on the polishing table by the top ring is performed in accordance with the preset polishing recipe. Then, the substrate transferring process in which the polished substrate is transferred to the wafer transferring position and is removed from the top ring, and the subsequent substrate to be polished is loaded onto the top ring, and then the top ring holding the subsequent substrate to be polished is returned to the polishing table, is performed. After the completion of the polishing recipe is detected, spraying of the cleaning fluid onto the polishing pad is started, and the pad cleaning process is initiated. The pad cleaning process is performed in the substrate transferring process. Then, at any time during the substrate transferring process, the position of the subsequent substrate to be polished is detected and the pad cleaning process is terminated. For example, the pad cleaning process is terminated by detecting the arrival of the subsequent substrate to be polished to the substrate transferring position. The detection of the position of the subsequent substrate to be polished may be performed by direct detection of the substrate, or indirect detection of the substrate such as detection of the position of the top ring. According to the present invention, the cleaning of the polishing pad (polishing surface) on the polishing table can be performed by using the idle time, in the substrate transferring process which is performed between the polishing processes, to the utmost limit.

In a preferred aspect of the present invention, the pad cleaning process is terminated by detecting the arrival of the subsequent substrate to be polished which is undergoing the substrate transferring process to the substrate transferring position.

According to the present invention, the pad cleaning process is started after the completion of the polishing recipe, and the pad cleaning process is terminated when the arrival of the subsequent substrate to be polished which is undergoing the wafer transferring process to the wafer transferring position (pusher) is detected.

In a preferred aspect of the present invention, a rotational speed of the polishing table is varied in the polishing process and the pad cleaning process.

According to the present invention, the rotational speed of the polishing table is varied in the polishing process and the pad cleaning process. Further, during the pad cleaning process also, the polishing pad may be rotated at a low speed when spraying (blowing) of the cleaning fluid onto the polishing pad is started, and then the polishing pad may be rotated at a high speed while spraying of the cleaning fluid onto the polishing pad is continued.

In a preferred aspect of the present invention, the rotational speed of the polishing table at the time of the pad cleaning process is higher than that at the time of the polishing process.

In a preferred aspect of the present invention, the polishing process comprises a polishing step for polishing the surface of the substrate and a dressing step for dressing the polishing pad.

In a preferred aspect of the present invention, the polishing process comprises a polishing step for polishing the surface of the substrate, a dressing step for dressing the polishing pad, and a polishing pad cleaning for removing foreign matters on the polishing pad by ejecting a cleaning fluid onto the polishing pad.

According to the present invention, the pad cleaning process can be performed continuously after the polishing pad cleaning performed in the polishing process. Therefore, a longer time for the polishing pad cleaning can be secured.

In a preferred aspect of the present invention, when a substrate or substrates are polished by at least two polishing tables, the polishing recipes in the respective polishing tables differ from each other.

According to the present invention, in the case where the substrate or substrates are respectively polished in two-steps by using the two polishing tables, the polishing recipes of the two polishing tables differ from each other. Because the polishing recipes differ, the time required for one of the polishing recipes differs from the time required for the other of the polishing recipes. Specifically, the time required for one of the polishing recipes in which the wafer is primarily polished by one of the polishing tables differs from the time required for the other of the polishing recipes in which the wafer is secondarily polished by the other of the polishing tables. Further, the time between the polishing recipes in one of the polishing tables and the time between the polishing recipes in the other of the polishing tables differ from each other. Therefore, the time for the polishing pad cleaning performed between the polishing recipes in one of the polishing tables differs from the time for the polishing pad cleaning performed between the polishing recipes in the other of the polishing tables.

In a preferred aspect of the present invention, when a plurality of substrates are polished sequentially by the one polishing table, the pad cleaning process is performed between the polishing recipe for polishing a preceding substrate and the polishing recipe for polishing a subsequent substrate.

According to another aspect of the present invention, there is provided a polishing apparatus capable of performing a polishing method; the polishing method comprising: a polishing process for polishing a surface of the substrate by pressing the substrate against a polishing pad on a polishing table by a top ring, the polishing process being executed in accordance with a preset polishing recipe; a pad cleaning process for removing foreign matters on the polishing pad by ejecting a cleaning fluid onto the polishing pad; and a substrate transferring process in which the polished substrate is removed from the top ring at a substrate transferring position, a subsequent substrate to be polished is loaded onto the top ring, and then the top ring holding the subsequent substrate to be polished is returned to the polishing table; wherein the pad cleaning process is started after the completion of the polishing recipe is detected, and the pad cleaning process is terminated by detecting a position of the subsequent substrate to be polished which is undergoing the substrate transferring process; wherein the polishing apparatus has a control unit configured to be able to set whether the pad cleaning process is executed.

According to the present invention, the control unit of the polishing apparatus has a setting mode, separated from setting of the polishing recipe, for setting whether the pad cleaning process is performed. By operating the setting mode, the pad cleaning process can be added between the polishing recipes.

The present invention offers the following advantages:

According to the present invention, the cleaning of the polishing pad (polishing surface) on the polishing table can be performed by using the idle time, in the substrate transferring process which is performed between the polishing processes, to the utmost limit. Therefore, the following effect can be expected.

(1) Without altering the polishing recipe, and without setting the polishing pad cleaning time, the polishing pad cleaning time can be secured. Therefore, desired polishing pad cleaning time can be secured without lowering a throughput.

(2) Because desired polishing pad cleaning time can be secured, agglomerated abrasive particles, existing on the polishing pad, can be removed as much as possible. Therefore, the occurrence of scratches on the surface of the substrate due to agglomerate of the particles on the polishing pad, can be dramatically reduced.

DETAILED DESCRIPTION

Figure 1:
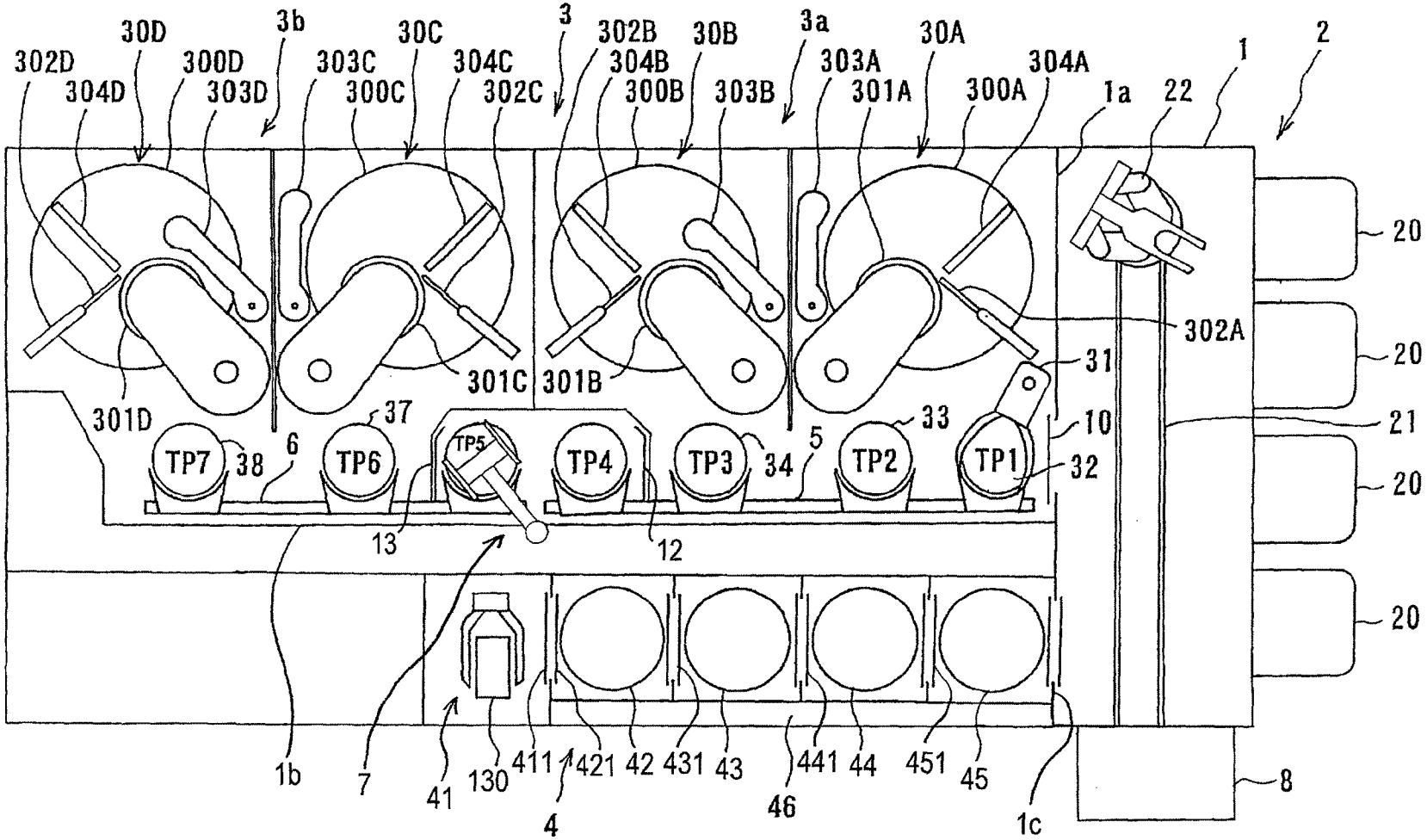
FIG. 1 is a plan view showing an entire structure of a polishing apparatus according to one embodiment of the present invention.

A polishing apparatus according to an embodiment of the present invention will be described below with reference to FIGS. 1 through 6. Like or corresponding parts are denoted by like or corresponding reference numerals in FIGS. 1 through 6 and will not be described below repetitively. In this embodiment, a semiconductor wafer will be described as a substrate to be polished.

FIG. 1 is a plan view showing an entire structure of a polishing apparatus according to the embodiment of the present invention. As shown in FIG. 1, the polishing apparatus according to the embodiment of the present invention has a housing 1 in a generally-rectangular shape. An interior space of the housing 1 is divided into a loading/unloading section 2, a polishing section 3 (3*a*, 3*b*), and a cleaning section 4 by partition walls 1*a*, 1*b* and 1*c*. The loading/unloading section 2, the polishing section 3 (3*a*, 3*b*), and the cleaning section 4 are assembled independently of each other, and air is discharged from these sections independently of each other.

The loading/unloading section 2 has two or more (four in this embodiment) front loading units 20 on which wafer cassettes, each storing plural semiconductor wafers, are placed. The front loading units 20 are arranged adjacent to each other along a width direction of the polishing apparatus (a direction perpendicular to a longitudinal direction of the polishing apparatus). Each of the front loading units 20 is capable of receiving thereon an open cassette, an SMIF (Standard Manufacturing Interface) pod, or a FOUP (Front Opening Unified Pod). The SMIF and FOUP are a hermetically sealed container which houses a wafer cassette therein and is covered with a partition to thereby provide an independent interior environment isolated from an external space.

Further, the loading/unloading section 2 has a moving mechanism 21 extending along an arrangement direction of the front loading units 20. A transport robot 22 is installed on the moving mechanism 21 and is movable along the arrangement direction of the wafer cassettes. The transport robot 22 is configured to move on the moving mechanism 21 so as to access the wafer cassettes mounted on the front loading units 20. The transport robot 22 has vertically arranged two hands, which can be separately used. For example, the upper hand is used for returning a semiconductor wafer to the wafer cassette, and the lower hand is used for transferring a semiconductor wafer before polishing.

The loading/unloading section 2 is required to be a cleanest area. Therefore, pressure in the interior of the loading/unloading section 2 is kept higher at all times than pressures in the exterior space of the polishing apparatus, the polishing section 3, and the cleaning section 4. A filter fan unit (not shown) having a clean air filter, such as a HEPA filter and a ULPA filter, is provided above the moving mechanism 21 of the transport robot 22. This filter fan unit removes particles, toxic vapor, and gas from air to produce clean air, and to form downward flow of the clean air at all times.

The polishing section 3 is an area where a semiconductor wafer is polished. This polishing section 3 includes a first polishing section 3*a* having therein a first polishing unit 30A and a second polishing unit 30B, a second polishing section 3*b* having therein a third polishing unit 30C and a fourth polishing unit 30D. The first polishing unit 30A, the second polishing unit 30B, the third polishing unit 30C, and the fourth polishing unit 30D are arranged along the longitudinal direction of the polishing apparatus as shown in FIG. 1.

As shown in FIG. 1, the first polishing unit 30A includes a polishing table 300A having a polishing pad (polishing surface), a top ring 301A for holding a semiconductor wafer and pressing the semiconductor wafer against the polishing pad on the polishing table 300A to polish the semiconductor wafer, a polishing liquid supply nozzle 302A for supplying a polishing liquid and a dressing liquid (e.g., water) onto the polishing pad, a dressing apparatus 303A for dressing the polishing pad on the polishing table 300A, and an atomizer 304A for ejecting a mixed fluid of a liquid (e.g., pure water) and a gas (e.g., nitrogen gas) or a liquid (e.g., pure water) in an atomized state onto the polishing pad from one or plural nozzles. Similarly, the second polishing unit 30B includes a polishing table 300B, a top ring 301B, a polishing liquid supply nozzle 302B, a dressing apparatus 303B, and an atomizer 304B. The third polishing unit 30C includes a polishing table 300C, a top ring 301C, a polishing liquid supply nozzle 302C, a dressing apparatus 303C, and an atomizer 304C. The fourth polishing unit 30D includes a polishing table 300D, a top ring 301D, a polishing liquid supply nozzle 302D, a dressing apparatus 303D, and an atomizer 304D.

A first linear transporter 5 is provided between the first polishing unit 30A and the second polishing unit 30B in the first polishing section 3*a*, and the cleaning section 4. This first linear transporter 5 is configured to transfer wafers between four transferring positions located along the longitudinal direction of the polishing apparatus (hereinafter, these four transferring positions will be referred to as a first transferring position TP1, a second transferring position TP2, a third transferring position TP3, and a fourth transferring position TP4 in the order from the loading/unloading section 2). A reversing machine 31 for reversing a wafer received from the transport robot 22 in the loading/unloading section 2 is disposed above the first transferring position TP1 of the first linear transporter 5. A vertically movable lifter 32 is disposed below the reversing machine 31. A vertically movable pusher 33 is disposed below the second transferring position TP2, and a vertically movable pusher 34 is disposed below the third transferring position TP3. A shutter 12 is provided between the third transferring position TP3 and the fourth transferring position TP4.

In the second polishing section 3*b*, a second linear transporter 6 is provided next to the first linear transporter 5. This second linear transporter 6 is configured to transfer substrates between three transferring positions located along the longitudinal direction of the polishing apparatus (hereinafter, these three transferring positions will be referred to as a fifth transferring position TP5, a sixth transferring position TP6, and a seventh transferring position TP7 in the order from the loading/unloading section 2). A pusher 37 is disposed below the sixth transferring position TP6 of the second linear transporter 6, and a pusher 38 is disposed below the seventh transferring position TP7 of the second linear transporter 6. A shutter 13 is provided between the fifth transferring position TP5 and the sixth transferring position TP6.

As can be understood from the fact that a slurry is used during polishing, the polishing section 3 is the dirtiest area. Therefore, in order to prevent particles from spreading out of the polishing section 3, evacuation is conducted from surrounding spaces of the respective polishing tables in this embodiment. In addition, pressure in the interior of the polishing section 3 is set to be lower than any of pressure outside the apparatus, pressure in the cleaning section 4, and pressure in the loading/unloading section 2, so that scattering of the particles is prevented. Typically, exhaust ducts (not shown) are provided below the polishing tables, respectively, and filters (not shown) are provided above the polishing tables, so that downward flows of cleaned air are formed through the filters and the exhaust ducts.

The polishing units 30A, 30B, 30C and 30D are each partitioned and closed by a partition wall, and the air is exhausted individually from each of the closed polishing units 30A, 30B, 30C and 30D. Thus, a semiconductor wafer can be processed in the closed polishing unit 30A, 30B, 30C or 30D without being influenced by the atmosphere of a slurry. This enables good polishing of the substrate. As shown in FIG. 1, the partition walls between the polishing units 30A, 30B, 30C and 30D each have an opening for passage of the linear transporters 5, 6. It is also possible to provide each opening with a shutter, and to open the shutter only when a wafer passes through the opening.

The cleaning section 4 is an area where polished semiconductor wafers are cleaned. The cleaning section 4 includes a reversing machine 41 for reversing a semiconductor wafer, four cleaning apparatuses 42, 43, 44 and 45 each for cleaning the polished semiconductor wafer, and a transferring unit 46 for transferring wafers between the reversing machine 41 and the substrate cleaning apparatuses 42, 43, 44 and 45. The reversing machine 41 and the substrate cleaning apparatuses 42, 43, 44 and 45 are arranged in series along the longitudinal direction of the polishing apparatus. A filter fan unit (not shown), having a clean air filter, is provided above the substrate cleaning apparatuses 42, 43, 44 and 45. This filter fan unit is configured to remove particles from air to produce clean air, and to form downward flow of the clean air at all times. Pressure in the interior of the cleaning section 4 is kept higher at all times than pressure in the polishing section 3, so that particles in the polishing section 3 are prevented from flowing into the cleaning section 4.

As shown in FIG. 1, a swing transporter (wafer transferring mechanism) 7 is provided between the first linear transporter 5 and the second linear transporter 6, for transferring a wafer between the first linear transporter 5, the second linear transporter 6, and the reversing machine 41 of the cleaning section 4. The swing transporter 7 is configured to transfer a wafer from the fourth transferring position TP4 of the first linear transporter 5 to the fifth transferring position TP5 of the second linear transporter 6, from the fifth transferring position TP5 of the second linear transporter 6 to the reversing machine 41, and from the fourth transferring position TP4 of the first linear transporter 5 to the reversing machine 41, respectively.

Figure 2:
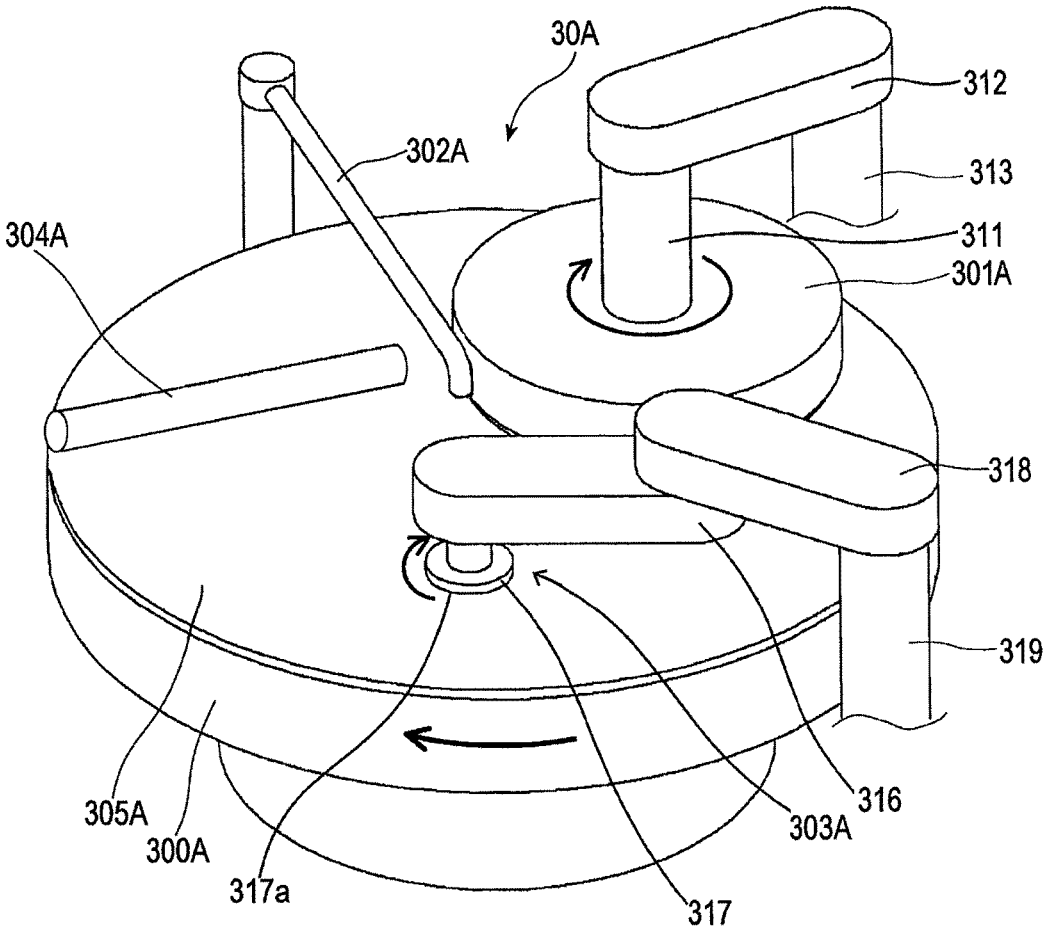
FIG. 2 is a schematic perspective view showing an entire structure of a first polishing unit of four polishing units shown in FIG. 1.

FIG. 2 is a schematic perspective view showing an entire structure of the first polishing unit 30A of the four polishing units shown in FIG. 1. Other polishing units 30B, 30C and 30D have the same structure as the first polishing unit 30A. As shown in FIG. 2, the first polishing unit 30A comprises a polishing table 300A, and a top ring 301A for holding a semiconductor wafer as an object to be polished and pressing the wafer against a polishing pad on the polishing table. The polishing table 300A is coupled via a table shaft to a polishing table rotating motor (not shown) disposed below the polishing table 300A. Thus, the polishing table 300A is rotatable about the table shaft. A polishing pad 305A is attached to an upper surface of the polishing table 300A. The upper surface of the polishing pad 305A constitutes a polishing surface for polishing the semiconductor wafer. The polishing pad 305A comprising SUBA 800, IC-1000, IC-1000/SUBA400 (two-layer cloth), or the like manufactured by the Dow Chemical Company is used. The SUBA 800 is non-woven fabrics bonded by urethane resin. The IC-1000 comprises a pad composed of hard polyurethane foam and having a large number of fine holes formed in its surface, and is also called a perforated pad. A polishing liquid supply nozzle 302A is provided above the polishing table 300A to supply a polishing liquid (slurry) onto the polishing pad 305A on the polishing table 300A.

The top ring 301A is connected to a shaft 311, and the shaft 311 is vertically movable with respect to a support arm 312. When the shaft 311 moves vertically, the top ring 301A is lifted and lowered as a whole for positioning with respect to the support arm 312. The shaft 311 is configured to be rotated by driving a top ring rotating motor (not shown). The top ring 301A is rotated about the shaft 311 by rotation of the shaft 311.

The top ring 301A is configured to hold the semiconductor wafer on its lower surface. The support arm 312 is configured to be pivotable about a shaft 313, thereby swinging the top ring 301A to a wafer transferring position (pusher 33, see FIG. 1) where the semiconductor wafer, which has been transferred, is held under vacuum by the top ring 301A. Thus, the top ring 301A, which holds the semiconductor wafer on its lower surface, is movable from the wafer transferring position (pusher 33) to a position above the polishing table 300A by pivotable movement of the support arm 312. Then, the top ring 301A holds the semiconductor wafer on its lower surface and presses the semiconductor wafer against the surface of the polishing pad 305A. At this time, while the polishing table 300A and the top ring 301A are respectively rotated, a polishing liquid (slurry) is supplied onto the polishing pad 305A from the polishing liquid supply nozzle 302A provided above the polishing table 300A. The polishing liquid containing silica ($SiO_2$) or ceria ($CeO_2$) as abrasive particles is used. A polishing step by the first polishing unit 30A is performed as follows: While the polishing liquid is supplied onto the polishing pad 305A, the semiconductor wafer is pressed against the polishing pad 305A and the semiconductor wafer and the polishing pad 305A are moved relative to each other, thereby polishing an insulating film, a metal film or the like on the semiconductor wafer.

As shown in FIG. 2, the dressing apparatus 303A comprises a dresser arm 316, a dresser 317 which is rotatably attached to a forward end of the dresser arm 316, and a dresser head 318 coupled to the other end of the dresser arm 316. The lower part of the dresser 317 comprises a dressing member 317*a*, and the dressing member 317*a* has a circular dressing surface. Hard particles are fixed to the dressing surface by electrodeposition or the like. Examples of the hard particles include diamond particles, ceramic particles and the like. A motor (not shown) is provided in the dresser arm 316, and the dresser 317 is rotated by the motor. The dresser head 318 is supported by a shaft 319.

A dressing step of the polishing pad 305A is performed as follows: The polishing table 300A is rotated and the dresser 317 is rotated by the motor, and then the dresser 317 is lowered by a lifting and lowering mechanism to bring the dressing member 317*a* provided at the lower surface of the dresser 317 into sliding contact with the polishing surface of the rotating polishing pad 305A. In this state, the dresser arm 316 is oscillated (swung), and thus the dresser 317 located at the forward end of the dresser arm 316 can move transversely from the outer circumferential end to the central part of the polishing surface of the polishing pad 305A. By this swing motion, the dressing member 317*a* can dress the polishing surface of the polishing pad 305A over the entire surface including the central part.

As shown in FIG. 2, the polishing unit 30A has the atomizer 304A for ejecting a mixed fluid of a liquid (e.g., deionized water) and a gas (e.g., nitrogen gas) or a liquid (e.g., deionized water) in an atomized state onto the polishing pad 305A from one or plural nozzles. The atomizer 304A is disposed above the polishing pad 305A so as to extend in parallel to the surface (polishing surface) of the polishing pad 305A and extends along substantially radial direction of the polishing pad 305A.

A cleaning process of the polishing pad 305A (polishing pad cleaning) by the atomizer 304A shown in FIG. 2 is performed as follows: While the polishing table 300A is rotated, a mixed fluid of a liquid and a gas or a liquid is ejected onto the polishing pad 305A from one or plural nozzles, thereby removing foreign matters (agglomerated abrasive particles, polishing debris and the like) on the polishing pad.

Figure 3A:
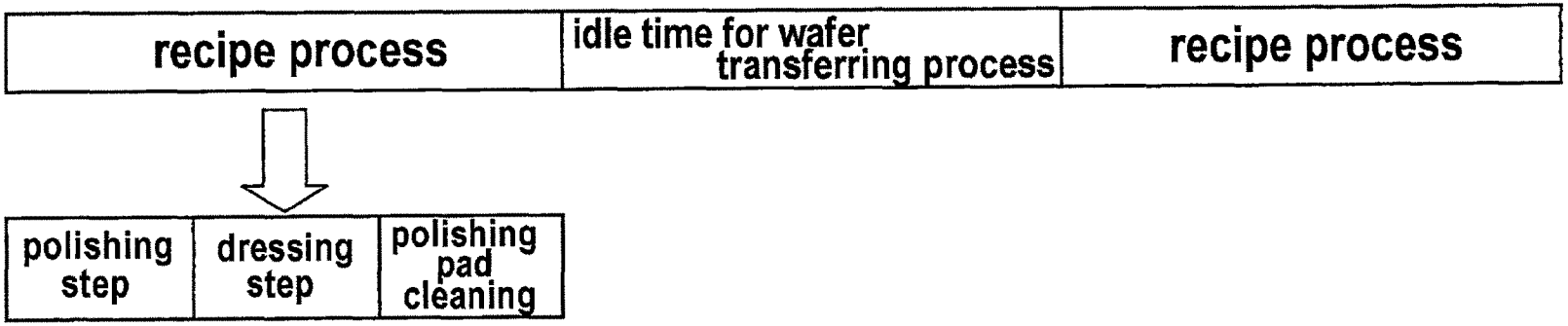
FIGS. 3A and 3B are timing diagrams for making a comparison of recipe processes, in the conventional example and the present invention, executed based on respective preset polishing recipes.
Figure 3B:
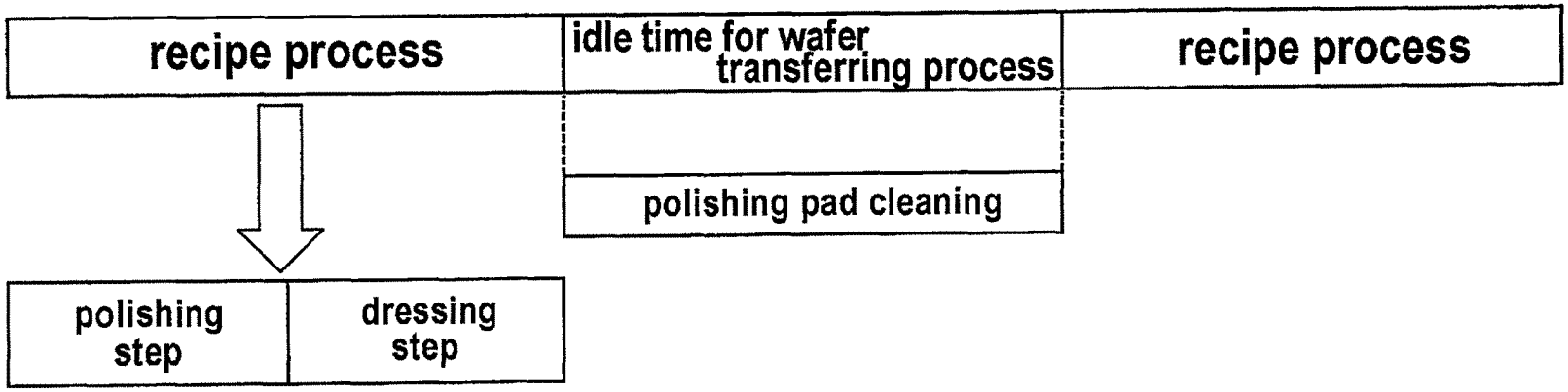

FIGS. 3A and 3B are timing diagrams for making a comparison of recipe processes, in the conventional example and the present invention, executed based on respective preset polishing recipes.

FIG. 3A shows a recipe process executed based on the polishing recipe in the conventional example. As shown in FIG. 3A, a recipe process comprising a polishing step, a dressing step, and a polishing pad cleaning (a predetermined cleaning time is set) is set in the polishing recipe. The polishing step, the dressing step, and the polishing pad cleaning are performed as described in the explanation of FIG. 2. When the polishing recipe is completed, a wafer transferring process for removing the polished semiconductor wafer from the top ring and loading a new semiconductor wafer on the top ring is performed. However, in the wafer transferring process, the polishing table has an idle time. Accordingly, in FIG. 3A, the idle time is shown as an idle time for wafer transferring process. At the moment when the polishing step is completed, the wafer transferring process may be started. In this case, the dressing step and the polishing pad cleaning which are the remaining steps of the polishing recipe are performed concurrently with the wafer transferring process. The wafer transferring process is not set in the polishing recipe, but is incorporated in a transferring sequence in the polishing apparatus. When the completion of the polishing recipe is detected by the controller, the wafer transferring process is started. When the wafer transferring process is completed (specifically, the polished semiconductor wafer is removed from the top ring and is transferred to the wafer transferring position, and the polished semiconductor wafer transferred to the wafer transferring position is transported to a next wafer transferring position, and then a subsequent semiconductor wafer to be polished which arrives at the wafer transferring position is detected), the polishing recipe of the subsequent semiconductor wafer is re-executed to execute the recipe process comprising the polishing step, the dressing step, and the polishing pad cleaning again (when the completion of the wafer transferring process is detected by the controller, the polishing recipe for the subsequent semiconductor wafer is executed).

FIG. 3B shows a recipe process executed based on the polishing recipe in the present invention. As shown in FIG. 3B, a recipe process comprising a polishing step and a dressing step is set in the polishing recipe. The polishing step and the dressing step are performed as described in the explanation of FIG. 2. When the polishing recipe is completed (the completion of the polishing recipe is detected by the controller), a wafer transferring process is performed in the same manner as the conventional example shown in FIG. 3A. However, in the wafer transferring process, the polishing table has an idle time. At the moment when the polishing step is completed, the wafer transferring process may be started. In this case, the dressing step which is the remaining step of the polishing recipe is performed concurrently with the wafer transferring process. As shown in FIG. 3B, according to the present invention, the "polishing pad cleaning" is performed by using the idle time, of the polishing table, for wafer transferring process. Then, when the wafer transferring process is completed (specifically, the polished semiconductor wafer is removed from the top ring and is transferred to the wafer transferring position, and the polished semiconductor wafer transferred to the wafer transferring position is transported to a next wafer transferring position, and then a subsequent semiconductor wafer to be polished which arrives at the wafer transferring position is detected by the controller), the "polishing pad cleaning" is terminated, and the polishing recipe of the subsequent semiconductor wafer is re-executed.

The "polishing pad cleaning" of the present invention is performed in a way that a mixed fluid of a liquid and a gas or a liquid is ejected (blown) onto the polishing pad 305A from the atomizer 304A while the polishing table 300A is rotated. After the blow of the mixed fluid or the liquid from the atomizer 304A is started, the rotational speed of the polishing table 300A may be increased, or may be kept at the same speed. Further, the blow of the mixed fluid or the liquid from the atomizer 304A and the dressing by the dresser 317 may be performed simultaneously. When the wafer transferring process is completed, the polishing recipe is re-executed.

Further, the polishing table has an idle time during a standby time such as lot change, and therefore the polishing pad cleaning may be performed by using this idle time.

Figure 4:
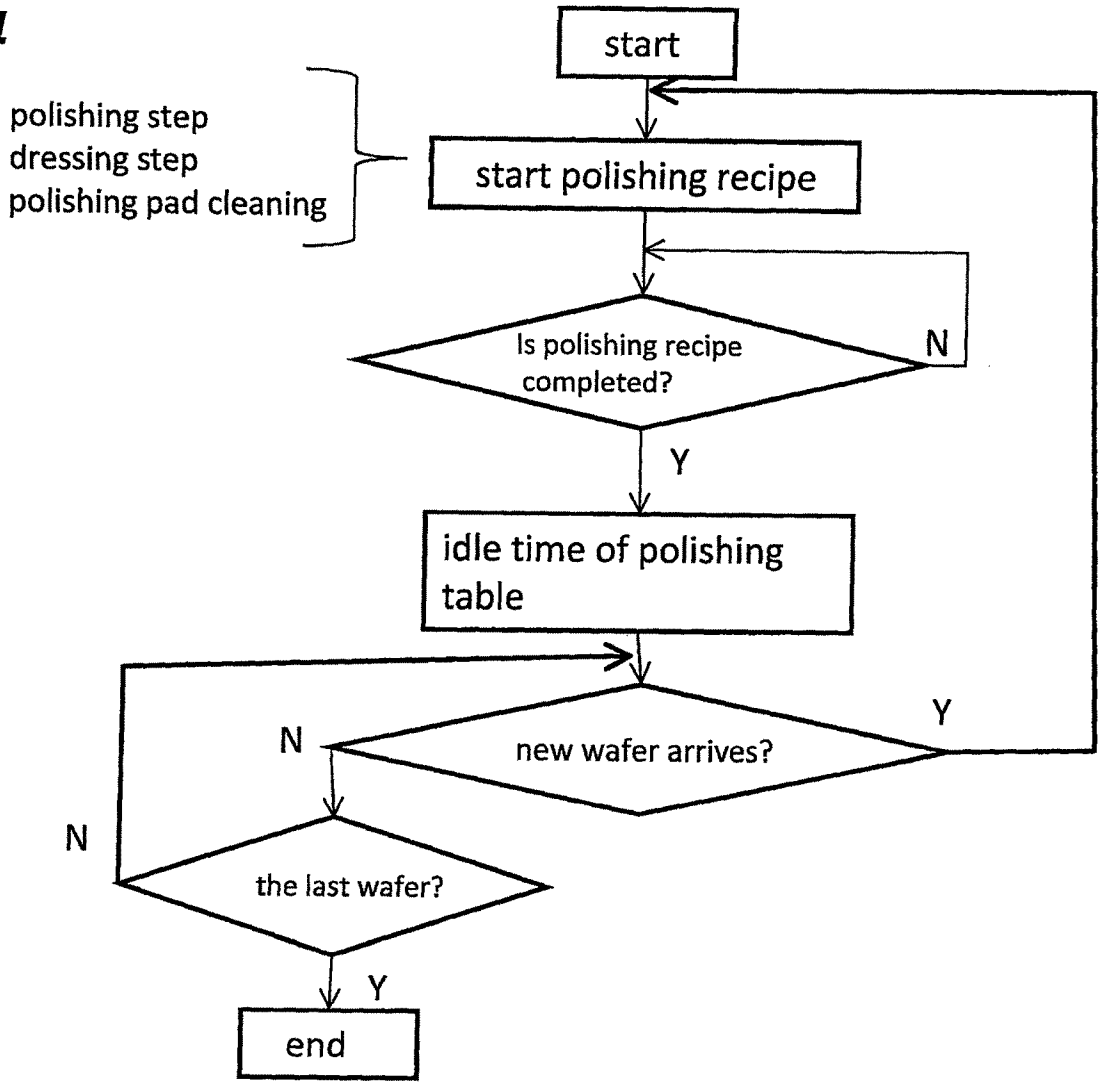
FIG. 4 is a flowchart showing a procedure of the recipe process executed based on the polishing recipe in the conventional example.

FIG. 4 is a flowchart showing a procedure of the recipe process executed based on the polishing recipe in the conventional example. As shown in FIG. 4, when the CMP process is started and the polishing recipe is initiated, the recipe process comprising the polishing step, the dressing step and the polishing pad cleaning shown in FIG. 3A is executed. Then, whether the polishing recipe is completed, is judged. When the polishing recipe is completed, the polishing table has the idle time. Next, whether a new semiconductor wafer to be subsequently polished arrives at the wafer transferring position is judged, and when the new semiconductor wafer arrives at the wafer transferring position, the processing is returned to the step for starting the polishing recipe. At the period to judge whether a new semiconductor wafer to be subsequently polished arrives at the wafer transferring position, whether the polished semiconductor wafer which has finished the polishing recipe and is undergoing the wafer transferring process is the last wafer, is judged before the new wafer arrives at the wafer transferring position. If the polished wafer is the last wafer, the polishing recipe is terminated because a new wafer is not transferred to the polishing table.

Figure 5:
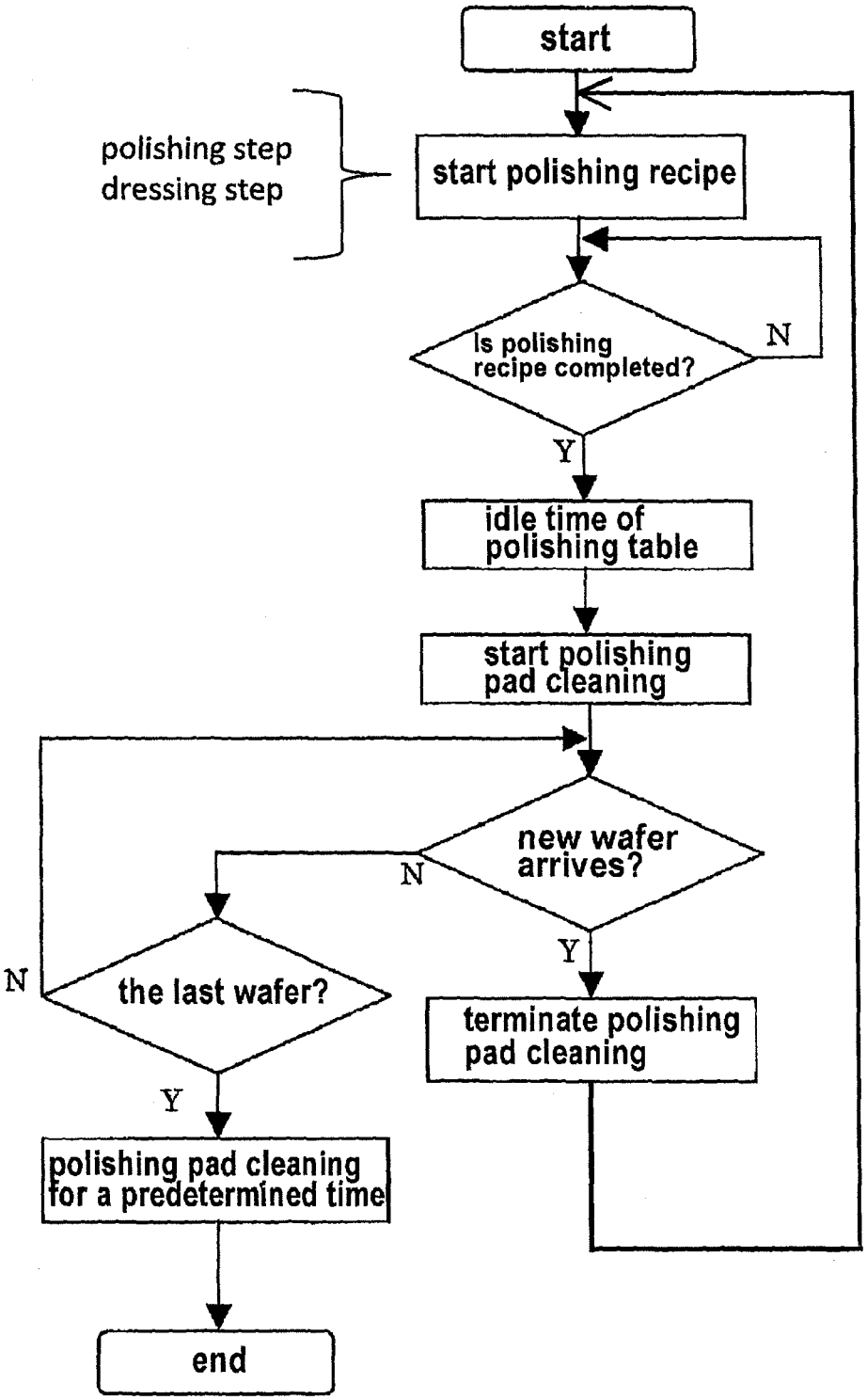
FIG. 5 is a flowchart showing a procedure of "polishing recipe" and "polishing pad cleaning" according to the present invention.

FIG. 5 is a flowchart showing a procedure of the "polishing recipe" and the "polishing pad cleaning" according to the present invention. As shown in FIG. 5, when the CMP process is started and the polishing recipe is initiated, the recipe process comprising the polishing step and the dressing step shown in FIG. 3B is executed. In the present invention, the period in which the polishing recipe is executed is referred to as a polishing process (recipe process). The polishing process may incorporate the polishing pad cleaning (a predetermined cleaning time is set) by the atomizer, in addition to the polishing step and the dressing step. Next, whether the polishing recipe is completed, is judged. When the polishing recipe is completed, the polishing table has the idle time, and the polishing pad cleaning is started by using the idle time. The polishing pad cleaning is performed in the way described in FIG. 3B. In the present invention, the period in which the polishing pad cleaning is performed is referred to as a pad cleaning process. When a new semiconductor wafer to be subsequently polished arrives at the wafer transferring position (pusher) and the arrival of the new semiconductor wafer is detected, the polishing pad cleaning is terminated.

In the flowchart shown in FIG. 5, after the completion of the polishing recipe is detected, the polishing pad cleaning, i.e., pad cleaning process is started. Then, when the semiconductor wafer to be subsequently polished arrives at the wafer transferring position and the arrival of the semiconductor wafer is detected, the polishing pad cleaning is stopped, i.e., the pad cleaning process is terminated. However, at any time during the wafer transferring process in which the polished semiconductor wafer is removed from the top ring at the wafer transferring position, the subsequent semiconductor wafer to be polished is loaded onto the top ring at the wafer transferring position, and then the top ring holding the subsequent semiconductor wafer to be polished is returned to the polishing table, the position of the subsequent semiconductor wafer may be detected and the polishing pad cleaning may be stopped, i.e., the pad cleaning process may be terminated. The detection of the position of the semiconductor wafer to be subsequently polished may be performed by direct detection of the wafer, or indirect detection of the wafer such as detection of the position of the top ring.

As shown in FIG. 5, at the period to judge whether a new semiconductor wafer to be subsequently polished arrives at the wafer transferring position, whether the polished semiconductor wafer which has finished the polishing recipe and is undergoing the wafer transferring process is the last wafer, is judged before the new wafer arrives at the wafer transferring position. If the polished wafer is the last wafer, the polishing pad cleaning is continued for a predetermined time because a new wafer is not transferred to the polishing table. Then, after the elapse of the predetermined time, the polishing pad cleaning is terminated.

As shown in FIGS. 3B and 5, according to the present invention, because the process for the polishing pad cleaning can be set separately from the polishing recipe, the polishing pad cleaning time can be variable. Specifically, the polishing pad cleaning time (e.g., several tens of seconds, or several minutes) is not set in the polishing recipe, but the polishing pad cleaning can be performed during the time between the termination of the polishing recipe and the re-execute of the subsequent polishing recipe. As described above, the polishing pad cleaning is performed by using the idle time of the polishing table in the wafer transferring process which is performed between the polishing recipes, and therefore the polishing pad cleaning time is not constant, but is variable.

Next, the reason why the polishing pad cleaning time is not constant will be described with specific examples.

Figure 6A:
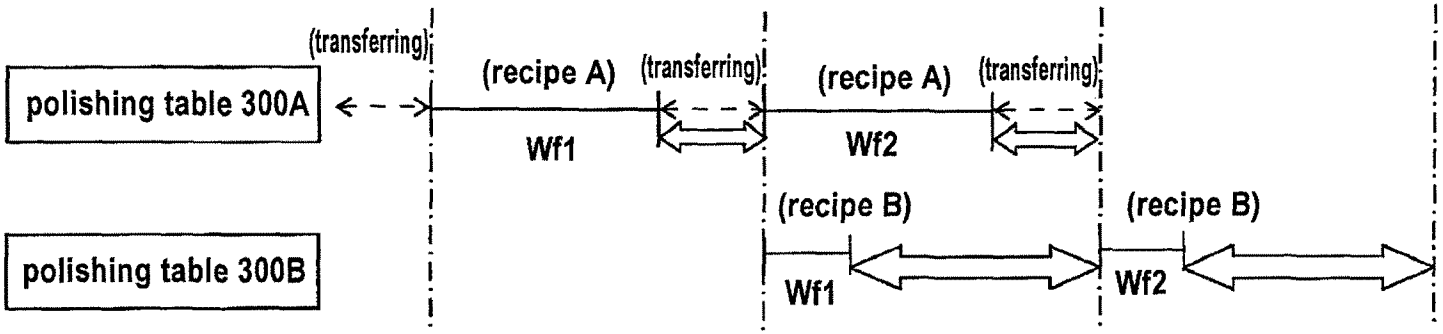
FIG. 6A is a timing diagram showing a case where a two-step polishing is performed by using two polishing tables at which different polishing recipes are executed respectively.

FIG. 6A is a timing diagram showing a case where a two-step polishing (a wafer is polished by using the polishing table 300A, and then the wafer polished by the polishing table 300A is sequentially polished by using the polishing table 300B) is performed by using two polishing tables at which different polishing recipes are executed respectively. In FIG. 6A, the intervals which are shown by double-headed white arrows correspond to the time for the polishing pad cleaning performed in the wafer transferring (transporting) process. As shown in FIG. 6A, in the case where two wafers (Wf1 and Wf2) are respectively polished in two-steps by using the polishing table 300A and the polishing table 300B (see FIG. 1), the polishing recipes of the two polishing tables differ from each other. Because the polishing recipes differ, the time required for one of the polishing recipes differs from the time required for the other of the polishing recipes. Specifically, the time required for the polishing recipe (recipe A) in which the wafer is primarily polished by the polishing table 300A is longer than the time required for the polishing recipe (recipe B) in which the wafer is secondarily polished by the polishing table 300B. In this manner, the time between the polishing recipes in the polishing table 300A and the time between the polishing recipes in the polishing table 300B differ, and thus the time for the polishing pad cleaning (the interval shown by a double-headed white arrow) performed between the polishing recipes in the polishing table 300A differs from the time for the polishing pad cleaning (the interval shown by a double-headed white arrow) performed between the polishing recipes in the polishing table 300B.

Figure 6B:
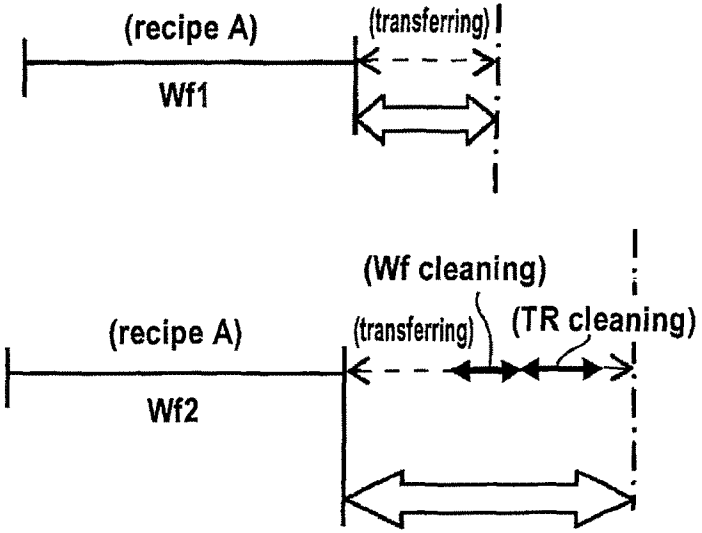
FIG. 6B is a timing diagram showing a case where cleaning of a wafer and cleaning of a top ring are performed at a wafer transferring position, and a case where neither cleaning of the wafer nor cleaning of the top ring is performed at the wafer transferring position.

FIG. 6B is a timing diagram showing a case where cleaning of a wafer and cleaning of a top ring are performed at the wafer transferring position, and a case where neither cleaning of the wafer nor cleaning of the top ring is performed at the wafer transferring position. FIG. 6B shows processing of two wafers (Wf1 and Wf2). In FIG. 6B, the intervals which are shown by double-headed white arrows correspond to the time for the polishing pad cleaning performed in the wafer transferring (transporting) process. In some cases, the polished semiconductor wafer is held by the top ring and transferred to the wafer transferring position (pusher), and pure water or the like is sprayed toward the wafer from below to clean the wafer while the wafer is held by the top ring at the wafer transferring position. This cleaning is referred to as a wafer cleaning (Wf cleaning). Further, in some cases, after the cleaned wafer is removed from the top ring, pure water or the like is sprayed toward the top ring from below to clean the top ring at the wafer transferring position. This cleaning is referred to as a top ring cleaning (TR cleaning).

In FIG. 6B, the upper timing diagram part shows the case where neither the wafer cleaning nor the top ring cleaning is performed, and the lower timing diagram part shows the case where both the wafer cleaning and the top ring cleaning are performed. As it is understood from the upper and lower timing diagram parts in FIG. 6B, in the case where the wafer cleaning and the top ring cleaning are performed, the time for the wafer transferring process is lengthened by a time for the wafer cleaning and the top ring cleaning, compared to the case where neither the wafer cleaning nor the top ring cleaning is performed. Therefore, in the case where the wafer cleaning and the top ring cleaning are performed, the time for the polishing pad cleaning (the interval shown by a double-headed white arrow) performed in the wafer transferring process is lengthened.

Although the embodiments of the present invention have been described herein, the present invention is not intended to be limited to these embodiments. Therefore, it should be noted that the present invention may be applied to other various embodiments within a scope of the technical concept of the present invention.

What is claimed is:

1. A polishing method for polishing a substrate, comprising:

a recipe process, being executed in accordance with a preset recipe, comprising:

a polishing step for polishing a surface of the substrate by pressing the substrate against a polishing pad on a polishing table by a top ring;

a dressing step for dressing the polishing pad; and a first cleaning step for removing foreign matters on said polishing pad by ejecting a cleaning fluid onto said polishing pad, a cleaning time of said first cleaning step being preset in advance in said recipe process;

a second cleaning step for removing foreign matters on said polishing pad by ejecting a cleaning fluid onto said polishing pad, a cleaning time of said second cleaning step being variable; and a substrate transferring process in which the polished substrate is removed from said top ring at a substrate transferring position, a subsequent substrate to be polished is loaded onto said top ring, and then said top ring holding the subsequent substrate to be polished is returned to said polishing table;

wherein said second cleaning step is started after the completion of said recipe process is detected, and said second cleaning step is terminated by detecting a position of the subsequent substrate to be polished which is undergoing said substrate transferring process.

2. The polishing method according to claim 1, wherein said second cleaning step is terminated by detecting the arrival of the subsequent substrate to be polished which is undergoing said substrate transferring process to said substrate transferring position.

3. The polishing method according to claim 1, wherein a rotational speed of said polishing table is varied in said polishing step and said second cleaning step.

4. The polishing method according to claim 3, wherein the rotational speed of said polishing table at the time of said second cleaning step is higher than that at the time of said polishing step.

5. The polishing method according to claim 1, further comprising a second recipe process including a second polishing step for polishing a surface of the substrate by pressing the substrate against a polishing pad on a second polishing table by a top ring, wherein said recipe processes in said respective polishing tables differ from each other.

6. A polishing apparatus capable of performing a polishing method;

said polishing method comprising:

a recipe process, being executed in accordance with a preset recipe, comprising:

a polishing step for polishing a surface of the substrate by pressing the substrate against a polishing pad on a polishing table by a top ring;

a dressing step for dressing the polishing pad; and a first cleaning step for removing foreign matters on said polishing pad by ejecting a cleaning fluid onto said polishing pad, a cleaning time of said first cleaning step being preset in advance in said recipe process;

a second cleaning step for removing foreign matters on said polishing pad by ejecting a cleaning fluid onto said polishing pad, a cleaning time of said second cleaning step being variable; and a substrate transferring process in which the polished substrate is removed from said top ring at a substrate transferring position, a subsequent substrate to be polished is loaded onto said top ring, and then said top ring holding the subsequent substrate to be polished is returned to said polishing table;

wherein said second cleaning step is started after the completion of said recipe process is detected, and said second cleaning step is terminated by detecting a position of the subsequent substrate to be polished which is undergoing said substrate transferring process.

7. The polishing apparatus according to claim 6, wherein said second cleaning step is terminated by detecting the arrival of the subsequent substrate to be polished which is undergoing said substrate transferring process to said substrate transferring position.

8. The polishing apparatus according to claim 6, wherein a rotational speed of said polishing table is varied in said polishing step and said second cleaning step.

9. The polishing apparatus according to claim 8, wherein the rotational speed of said polishing table at the time of said second cleaning step is higher than that at the time of said polishing step.

10. The polishing apparatus according to claim 6, further comprising a second recipe process including a second polishing step for polishing a surface of the substrate by pressing the substrate against a polishing pad on a second polishing table by a top ring, wherein said recipe processes in said respective polishing tables differ from each other.

* * * * *